US010869540B2

(12) United States Patent
Ackerman et al.

(10) Patent No.: US 10,869,540 B2
(45) Date of Patent: Dec. 22, 2020

(54) FLAYED BACKPACK COLLAPSIBLE SUSPENSION CHAIR

(71) Applicants: Peter Ackerman, Lehi, UT (US); Christopher Michael Ackerman, South Jordan, UT (US); Christian Lane Hansen, Salt Lake City, UT (US)

(72) Inventors: Peter Ackerman, Lehi, UT (US); Christopher Michael Ackerman, South Jordan, UT (US); Christian Lane Hansen, Salt Lake City, UT (US)

( * ) Notice: Subject to any disclaimer, the term of this patent is extended or adjusted under 35 U.S.C. 154(b) by 0 days.

(21) Appl. No.: 15/794,275

(22) Filed: Oct. 26, 2017

(65) Prior Publication Data

US 2018/0110318 A1 Apr. 26, 2018

Related U.S. Application Data

(60) Provisional application No. 62/413,303, filed on Oct. 26, 2016.

(51) Int. Cl.

| | |
|---|---|
| ***A45F 4/02*** | (2006.01) |
| ***A47C 9/10*** | (2006.01) |
| ***A47C 4/30*** | (2006.01) |
| ***A47C 4/52*** | (2006.01) |
| ***A45F 3/04*** | (2006.01) |
| *A45F 3/00* | (2006.01) |

(52) U.S. Cl.

CPC ..... *A45F 4/02* (2013.01); *A45F 3/04* (2013.01); *A47C 4/30* (2013.01); *A47C 4/52* (2013.01); *A47C 9/10* (2013.01); *A45F 2003/003* (2013.01); *A45F 2004/026* (2013.01)

(58) Field of Classification Search

CPC ..... A45F 2004/026; A45F 4/02; A45F 3/04; A47C 4/30; A47C 4/52

See application file for complete search history.

(56) References Cited

U.S. PATENT DOCUMENTS

| | | | | |
|---|---|---|---|---|
| 5,209,381 | A * | 5/1993 | Jay | A45F 4/02 224/155 |
| 5,467,487 | A * | 11/1995 | Sicard | A45C 3/10 190/2 |
| 6,347,406 | B1 * | 2/2002 | Jones | A45F 4/02 2/69 |
| 7,153,025 | B1 * | 12/2006 | Jackson | A45C 7/0059 383/2 |

(Continued)

*Primary Examiner* — Derek J Battisti

(74) *Attorney, Agent, or Firm* — Lyman Moulton, Esq.; Moulton Patents, PLLC

(57) ABSTRACT

A disclosed backpack chair includes a bag comprising a top piece, a back piece, two symmetric side pieces, an apron and a bottom piece sewn together like a hooded vest and zippered up a front center thereof with a perimeter of the bottom piece to form the bag. A tri zipper track and a penta slider pull connects a perimeter of the two equal side pieces to a perimeter of the head piece and to perimeter of the bottom piece to form the bag. The backpack chair also includes suspension pockets at reinforced corners of the bag to receive collapsible pole members of a suspending structure. The backpack chair further includes at least one strap detachably connected to the bag to allow the bag to be carried on a user's back, a user's shoulder and in a user's hand or crook of a user's arm or around a user's waist.

19 Claims, 7 Drawing Sheets

(56) References Cited

U.S. PATENT DOCUMENTS

| | | | | |
|---|---|---|---|---|
| 8,079,451 | B2 * | 12/2011 | Rothschild | A45F 4/06 190/100 |
| 9,635,915 | B2 * | 5/2017 | Salibi | A45C 7/0086 |
| 9,918,553 | B2 * | 3/2018 | Brune | E04H 15/001 |
| 2003/0080592 | A1 * | 5/2003 | Isom | A45F 4/02 297/16.2 |
| 2010/0219222 | A1 * | 9/2010 | Winneur | A45C 9/00 224/629 |
| 2015/0076182 | A1 * | 3/2015 | Coleman | A45F 3/04 224/155 |
| 2015/0196110 | A1 * | 7/2015 | Robert | A45F 3/08 224/633 |
| 2017/0055680 | A1 * | 3/2017 | Donato, Jr. | A45F 3/005 |

* cited by examiner

FLAYED BACKPACK COLLAPSIBLE SUSPENSION CHAIR

CROSS-REFERENCE TO RELATED APPLICATION

This application claims the benefit of the priority date of earlier filed U.S. Provisional Patent Application Ser. No. 62/413,303, titled 'A Flayed Backpack Collapsible Suspension Chair,' filed Oct. 26, 2016 by Peter Ackerman, and is incorporated herein by reference in its entirety.

BACKGROUND OF THE INVENTION

Conventional frame back pack chairs typically have fixed and rigid back supports and rigid seat members which double as members of a frame for a backpack. These conventional frame back pack chairs are akin to large bulky lawn chairs and are heavy and limited in adaptability for other purposes. Traditional frame back pack chairs therefore have not enjoyed widespread success in the marketplace.

With the advent and rising popularity and proliferation of collapsible suspension type outdoor chairs, conventional frame back pack chairs have become antiquated garage sale fodder. However, a collapsible suspension type outdoor chair is made from a gusseted tent like fabric with a collapsible frame that is dead weight to a hiker and not adaptable to a backpack frame.

There is therefore a long felt need in the market for a functional, light-weight and convenient backpack that is also able to transform into a camping chair and transform into other camping gear.

SUMMARY OF THE INVENTION

A disclosed backpack chair includes a bag comprising a top piece, a back piece, two symmetric side pieces, an apron and a bottom piece sewn together like a hooded vest and zippered together up a front center thereof with a perimeter of the bottom piece to form the bag. The backpack chair also includes tri zipper track and a penta slide pull at least one zipper configured to seam a perimeter of the two equal side pieces to a perimeter of the head piece and to perimeter of the bottom piece to form the bag. The zipper 35 brings together edge seams of the two side pieces. The backpack chair also includes a plurality of suspension pockets disposed at reinforced corners of the bag, the suspension pockets configured to receive members of a suspending structure. The backpack chair further includes at least one strap detachably connected to the bag, the at least one strap configured to allow the bag to be carried on a user's back, a user's shoulder and in a user's hand or crook of a user's arm or around a user's waist.

A method of transforming a backpack into a furnishing for a body at rest includes providing a bag comprising a top hood piece, a back piece, two equal side pieces and a bottom piece sewn together like a hooded vest and zippered together up a front center thereof to form the bag. The method also includes flaying the bag open to form a canvas for a suspended chair via at least one zipper configured to seam a perimeter of the two equal side pieces to a perimeter of the head piece and to a perimeter of the bottom piece. The method further includes inserting rigid pole members into a plurality of suspension pockets disposed at corners of the bag to interconnect the rigid members into a suspending understructure.

Other aspects and advantages of embodiments of the disclosure will become apparent from the following detailed description, taken in conjunction with the accompanying drawings, illustrated by way of example of the principles of the disclosure herein.

Figure 1:
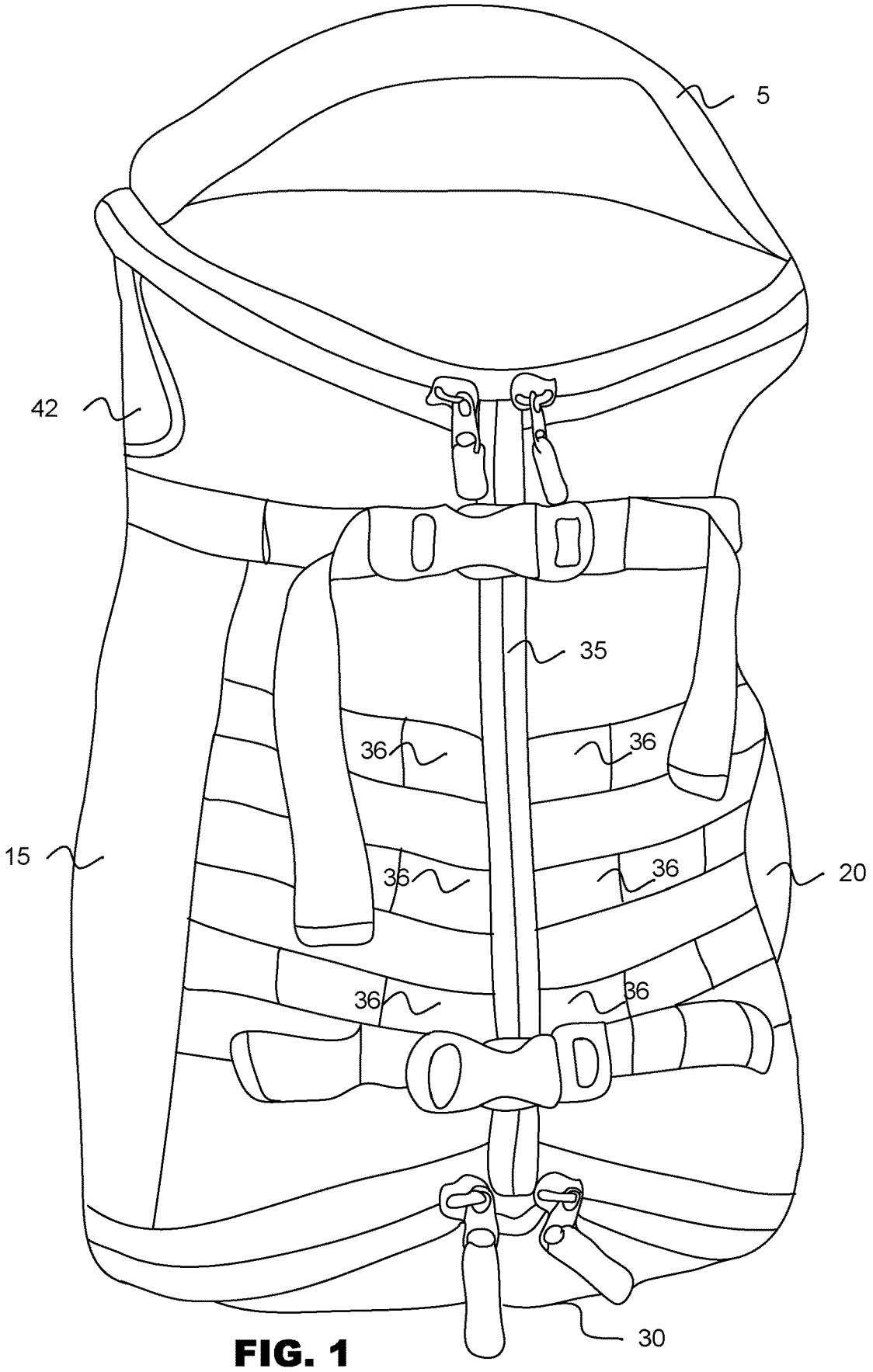
FIG. 1 is a front side perspective view of an assembled and secured backpack collapsible suspension chair in accordance with an embodiment of the present disclosure.

Throughout the description, similar and same reference numbers may be used to identify similar and same elements in the several embodiments and drawings. Although specific embodiments of the invention have been illustrated, the invention is not to be limited to the specific forms or arrangements of parts so described and illustrated. The scope of the invention is to be defined by the claims appended hereto and their equivalents.

DETAILED DESCRIPTION

Reference will now be made to exemplary embodiments illustrated in the drawings and specific language will be used herein to describe the same. It will nevertheless be understood that no limitation of the scope of the disclosure is thereby intended. Alterations and further modifications of the inventive features illustrated herein and additional applications of the principles of the inventions as illustrated herein, which would occur to a person of ordinary skill in the relevant art and having possession of this disclosure, are to be considered within the scope of the invention.

Throughout the present disclosure, the term 'bivy shelter' refers to a small, lightweight and waterproof bivouac shelter as an alternative to a traditional or full tent system used for mountain climbers, hikers, soldiers and recreational campers. The term 'transform' used throughout the present specification and claims refers to an ability to adapt the present backpack and chair components into other structures including partial and full bivouac shelters, sleeping matts and hammocks and vest insulated clothing. The term 'dart,' refers to a reinforced fabric or canvas area including or adjacent a 'suspension pocket,' designed and constructed for receiving an end of an understructure member. The term 'inside out,' refers to an inner surface of the backpack turned outward for sitting.

FIG. 1 is a front side perspective view of an assembled and secured backpack collapsible suspension chair in accordance with an embodiment of the present disclosure. A disclosed backpack chair includes a bag comprising a top piece 5, a back piece 10 (not shown), two symmetric side pieces 15 and 20, an apron 25 and a bottom piece 30 sewn together like a hooded vest and zippered together up a front center thereof with a perimeter of the bottom piece to form the bag. The backpack chair also includes at least one zipper 35 configured to seam a perimeter of the two equal side pieces to a perimeter of the head piece and to perimeter of the bottom piece to form the bag. The zipper 35 brings together edge seams of the two side pieces 15 and 20. The backpack chair also includes a plurality of reinforced darts 42 (outside depiction) disposed at corners of the bag. Adjacent inside the reinforced darts 42 are suspension pockets to receive members of a suspending structure 45. The backpack chair further includes at least one strap detachably connected to the bag 50, the at least one strap configured to allow the bag to be carried on a user's back, a user's shoulder and in a user's hand or crook of a user's arm or around a user's waist. MOLLE modular Lightweight Load-carrying Equipment straps 36 are sewn at intervals onto the side pieces 15 and 20 longitudinally to provide secure attachment for ropes, bungee, hooks and other camping gear.

An embodiment of the disclosure includes a tri zipper track comprises a top zipper track configured to seam the top hood piece to the two equal side pieces, a bottom zipper track to seam the bottom piece to the two equal side pieces and a center zipper track to seam the two equal side pieces together. Also a penta slider pull comprises a first slider pull on a first portion of the top zipper track, a second slider pull on another section of the top zipper track, a third slider pull on a first portion of the bottom zipper track, a fourth slider pull on another section of the bottom zipper track and a fifth slider pull on the center zipper track.

Figure 2:
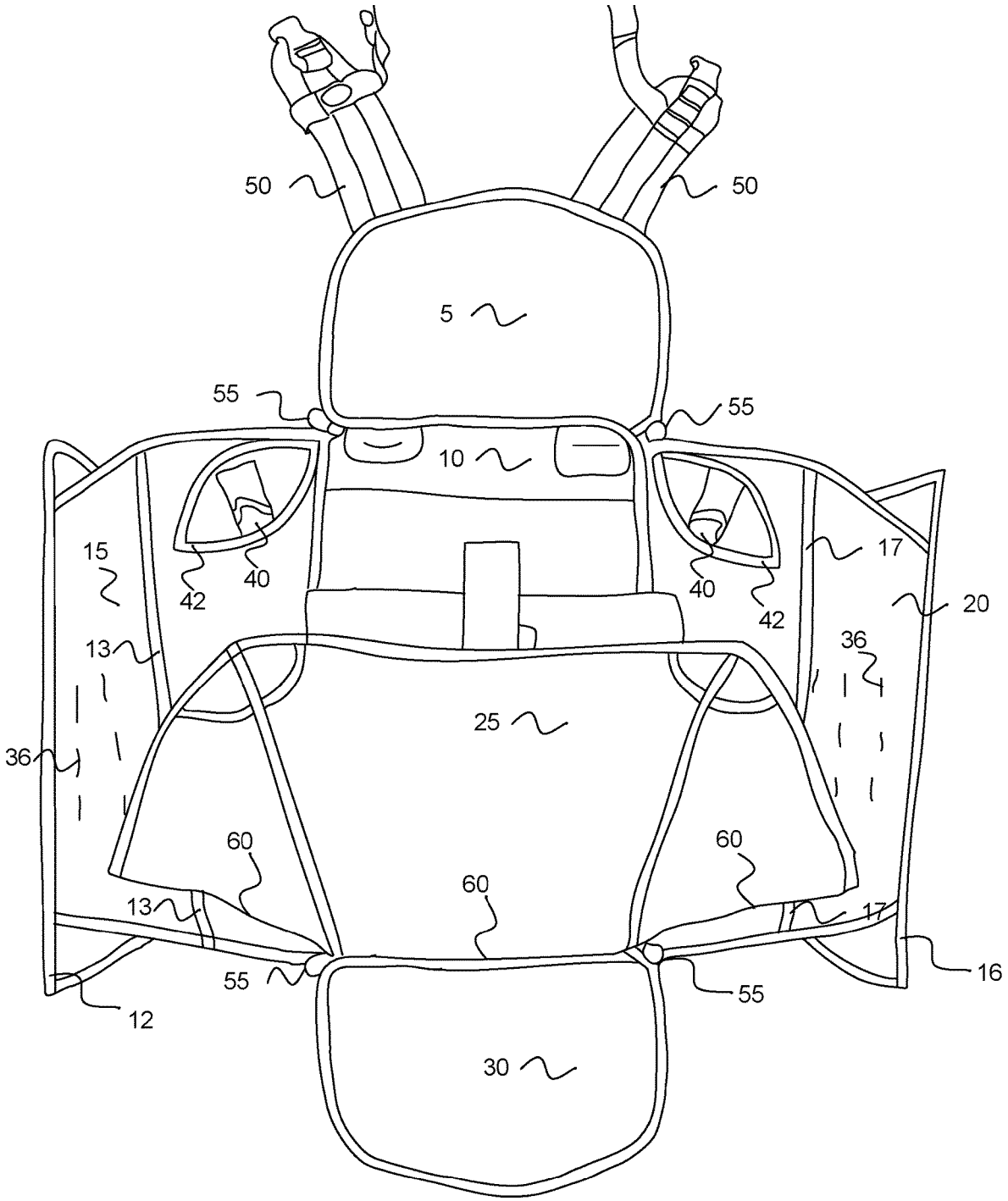
FIG. 2 is an inside perspective view of a flayed open backpack collapsible suspension chair in accordance with an embodiment of the present disclosure.

FIG. 2 is an inside perspective view of a flayed open backpack collapsible suspension chair in accordance with an embodiment of the present disclosure. Reference numbers used in other figures may be the same as depicted here to illustrate same or similar features of the disclosure. Additionally, zipper heads 55 depict a start or end of a zipper. Apron seams 60 secure the apron 25 to the back piece 10 and form the seat of the chair when the apron 25 is flayed out as will be illustrated. The seams of the MOLLE straps 36 on the side pieces 15 and 20 are visible on this inside of the backpack. The suspension pockets 40 are adjacent inside the reinforced darts 42 and are shown ready to receive a suspension member pole therein as will be depicted in FIG. 4. The zipper 35 brings together respective edge seams 12 and 16 of the two side pieces 15 and 20.

In some embodiments, the two equal side pieces may include detachable rolls or duffels (cylindrical bags) attached and detached at zippers 13 and 17 without emptying content of the backpack or of the two equal side pieces 15 and 20 to the respective side piece edge seams 12 and 16 and rolled inside the bag when it is zipped up. These side bags, also known as switch bags may be used independently of the composite backpack.

Figure 3:
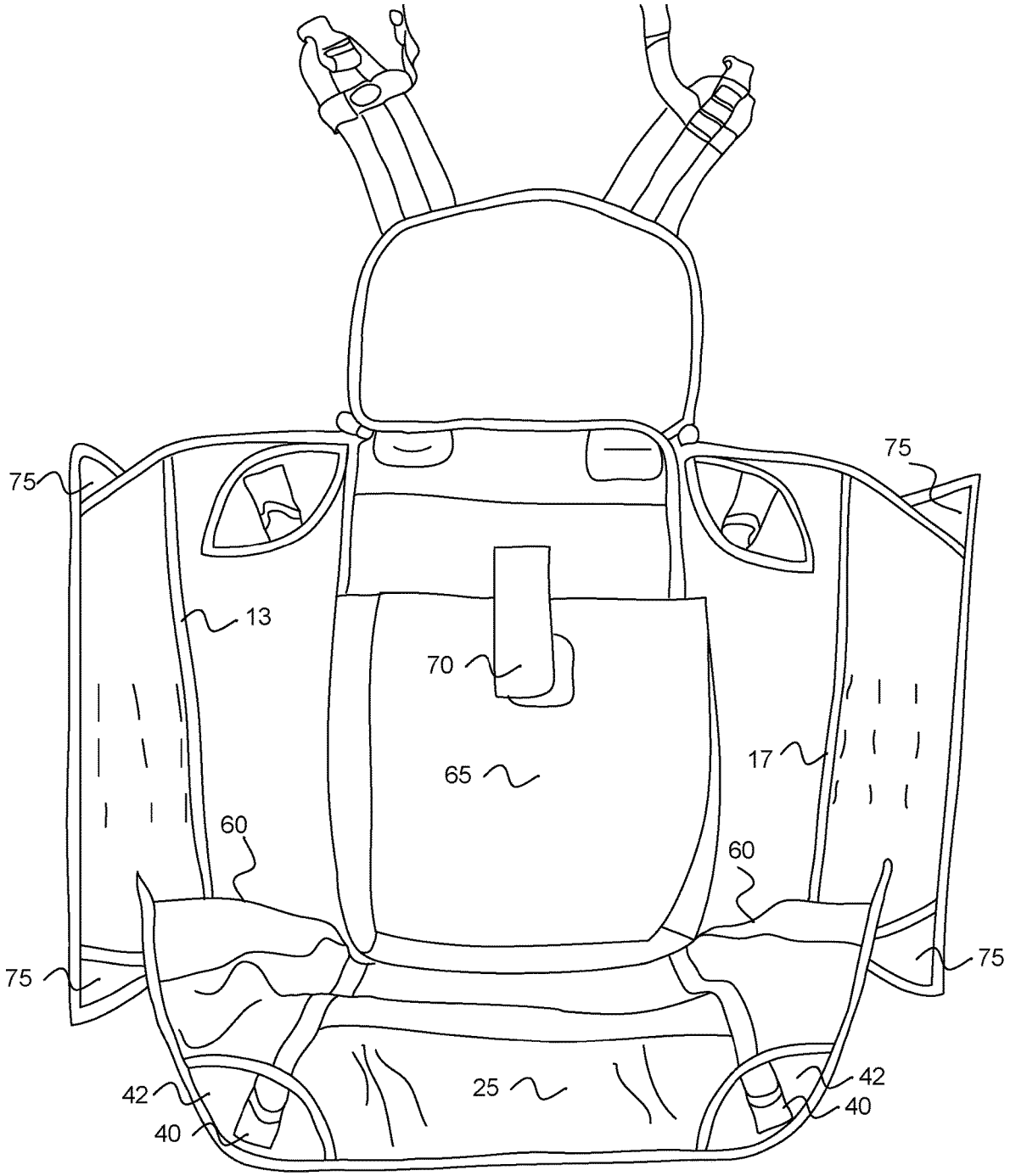
FIG. 3 is an inside perspective view of a flayed backpack collapsible suspension chair prepared for mount in accordance with an embodiment of the present disclosure.

FIG. 3 is an inside perspective view of a flayed backpack collapsible suspension chair prepared for mount in accordance with an embodiment of the present disclosure. Reference numbers used in other figures may be the same as depicted here to illustrate same or similar features of the disclosure. Additionally, pocket 65 has a hook and loop closure 70 to secure personal effects within the backpack. Suspension pockets 40 on the apron are now visible. The suspension pockets are adjacent reinforced darts 42 at respective two corners of the back and the two corners of the apron. The apron 25 is sewn into a cupping shape inside out to accommodate a person sitting therein and therefore may not flay out completely flat. Tri-zippers 75 are configured at the four corners of the back piece. Tri-zippers 75 are illustrated more fully in FIG. 6 where the four corners triangulate with the top piece and triangulate with the bottom piece to form a sealed bag.

Figure 4:
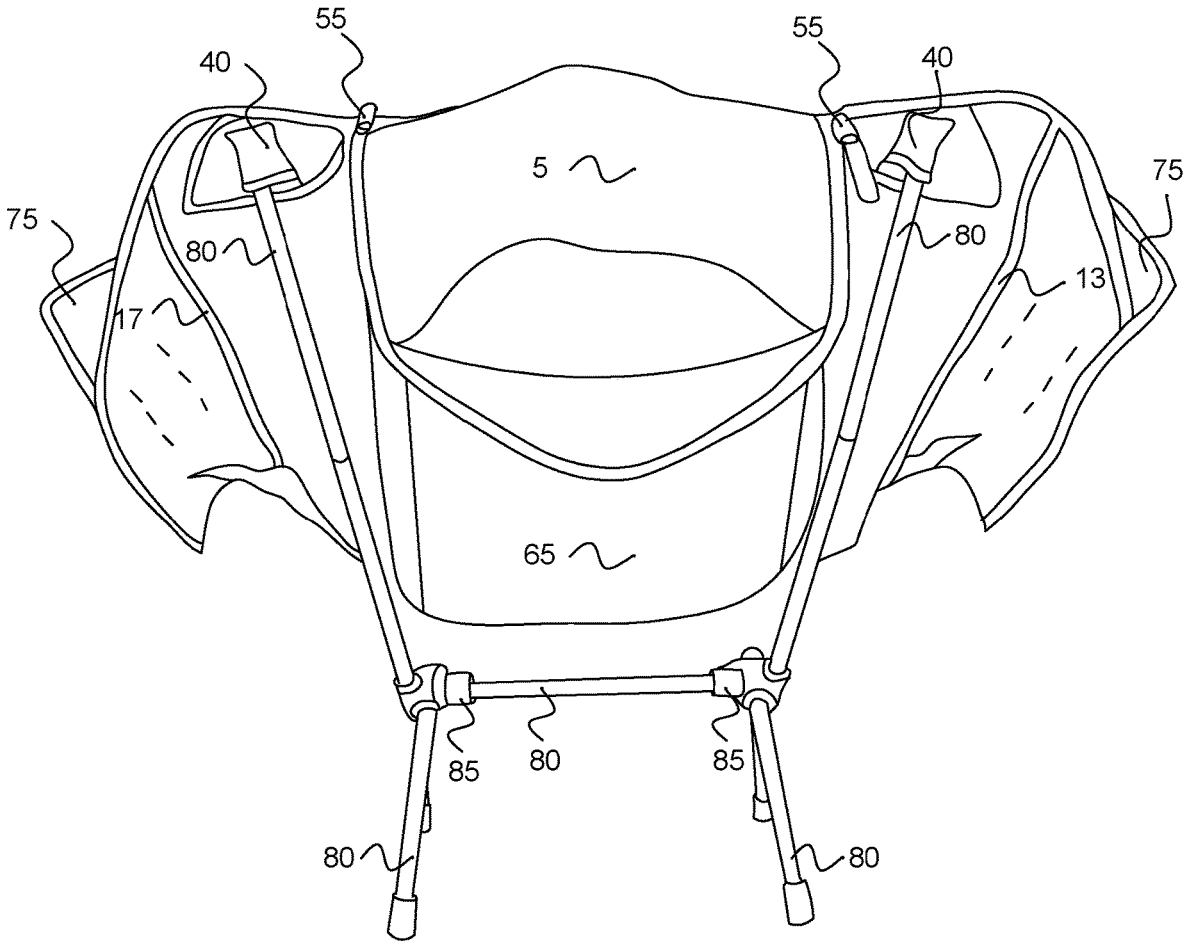
FIG. 4 is a back perspective view of a mounted flayed backpack collapsible suspension chair in accordance with an embodiment of the present disclosure.

FIG. 4 is a back perspective view of a mounted flayed backpack collapsible suspension chair in accordance with an embodiment of the present disclosure. Reference numbers used in other figures may be the same as depicted here to illustrate same or similar features of the disclosure. Additionally, the understructure members 80 are inserted into the suspension pockets 40 and into hub sockets 85 to form the understructure. The understructure members 80 may be lightweight aluminum composite poles with elastic stringers inside to keep them together in disassembly. The hub sockets 85 may be formed from hard epoxy plastics and other high durometer lightweight materials. The pocket 65 now provides an outside storage area for personal effects of the person using the chair.

An embodiment of the disclosed backpack chair includes a plurality of lightweight aluminum poles configured to interconnect into a suspending understructure. A pocket in the hood piece is adapted to receive and to store the strap(s) detached from the bottom piece. A plurality of grommets are disposed adjacent the darts for straps, ropes, cords etc attached between the grommets and a supporting structure to form a hammock.

Another embodiment of the disclosure is adapted for the bag to be flayed open and multiple pads or an inflatable bladder on the back piece, and optionally on the top hood piece, the side pieces and the bottom piece transforms the backpack into a sleeping pad for a user. The bag is also flayed open to transform into a hooded vest where the top piece 5 acts as the hood, back piece 10 acts as the vest back and side pieces 15 and 20 act as sides of the hooded vest, zipperable up the sides via seams 13 and 17 to be worn by a user. A plurality of chest straps are adapted to be turned backwards to strap the bag to the interconnected suspending understructure.

In yet another embodiment of the disclosure, the two equal side pieces comprise pockets configured both for backpack use and for chair accessories. The equal side pieces are entirely detachable from the bag by zippered seams. A plurality of webbing straps sewn onto an outside of the two equal sides.

The disclosed backpack chair therefore includes a bag comprising a top hood piece, a back piece, two equal side pieces and a bottom piece seamed together like a hooded vest and zippered together up a front center thereof with a perimeter of the bottom piece to form the bag. The backpack chair also includes a first zipper configured to seam a perimeter of a left side piece to a left perimeter of the head piece and to a left perimeter of the bottom piece to form a left half of the bag. The backpack chair additionally includes a second zipper configured to seam a perimeter of a right side piece to a right perimeter of the head piece and to a right perimeter of the bottom piece to form a right half of the bag. The backpack chair further includes a plurality of suspension darts disposed at corners of the bag including two each disposed at two bottom corners thereof for rigid members to be inserted therein to interconnect into a suspending understructure. The disclosed backpack chair yet includes two shoulder straps attached to the bag that allow it to be carried on one's back, the shoulder straps securely attached to a top of the back piece and detachably connected to a back of the bottom piece.

An embodiment of the backpack chair includes a third zipper configured to zip together matching outer perimeters of the left side piece and the right side piece. The back pack chair also includes a plurality of lightweight aluminum poles configured to interconnect into a suspending understructure.

Figure 5:
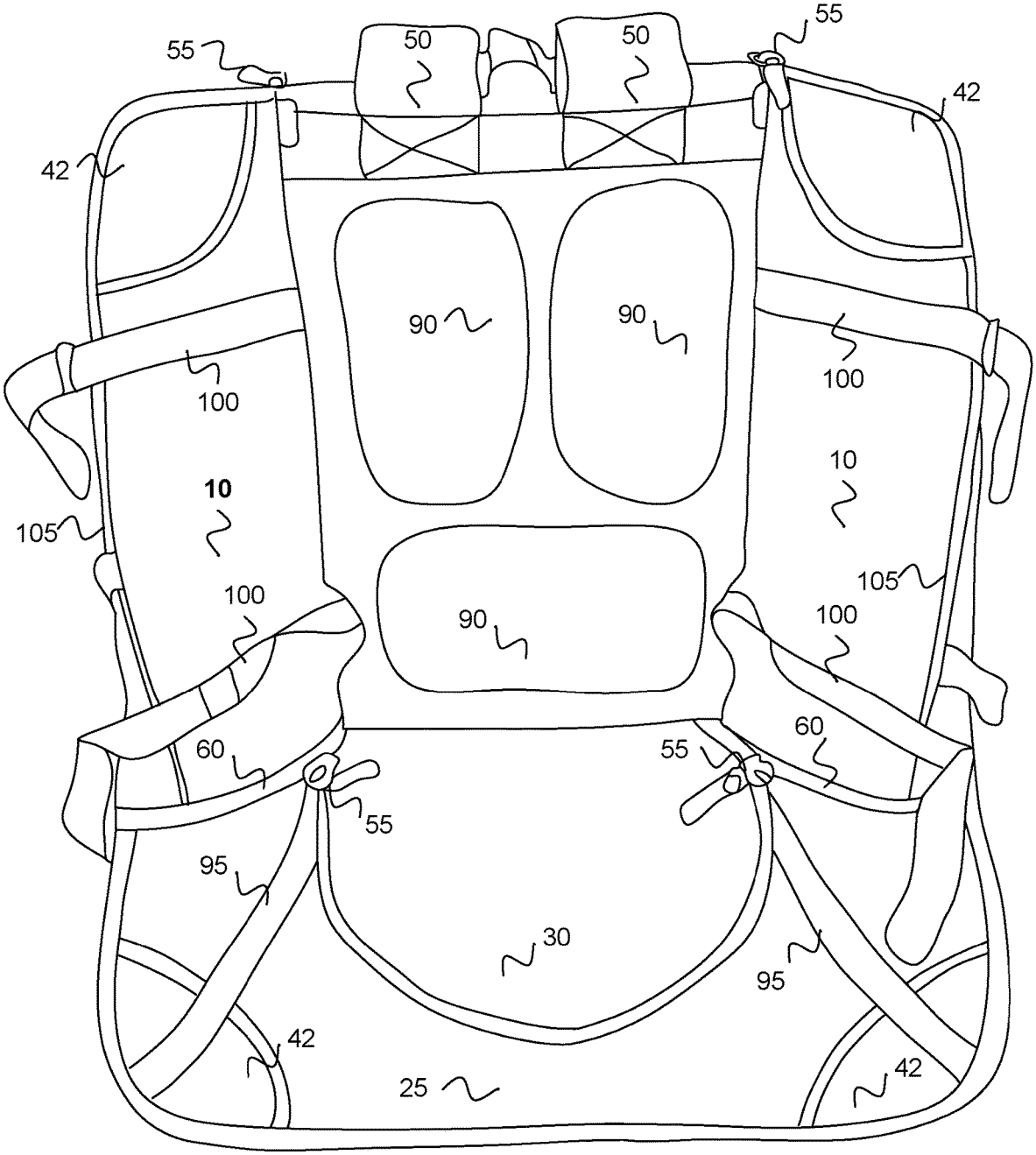
FIG. 5 is an outside top perspective view of a flayed backpack collapsible suspension chair mounted in accordance with an embodiment of the present disclosure.

FIG. 5 is an outside top perspective view of a flayed backpack collapsible suspension chair mounted in accordance with an embodiment of the present disclosure. Reference numbers used in other figures may be the same as depicted here to illustrate same or similar features of the disclosure. Additionally, multiple pads 90 on the back piece for back pack use are also used as padding for chair use. Apron seat seams 95 allow the apron to be formed into a spoon shaped seat for the chair user. Circumferential straps 100 attach to the back piece 10 and wrap around the back side of the chair and the suspension members and attach together to further secure the bag to the under suspension. Four circumferential straps are depicted but more or fewer may be used depending on design for different embodiments. The side pieces 15 and 20 are not viewable from the top front of the chair depicted because they hang from the edge seam 105 of the chair.

Figure 6:
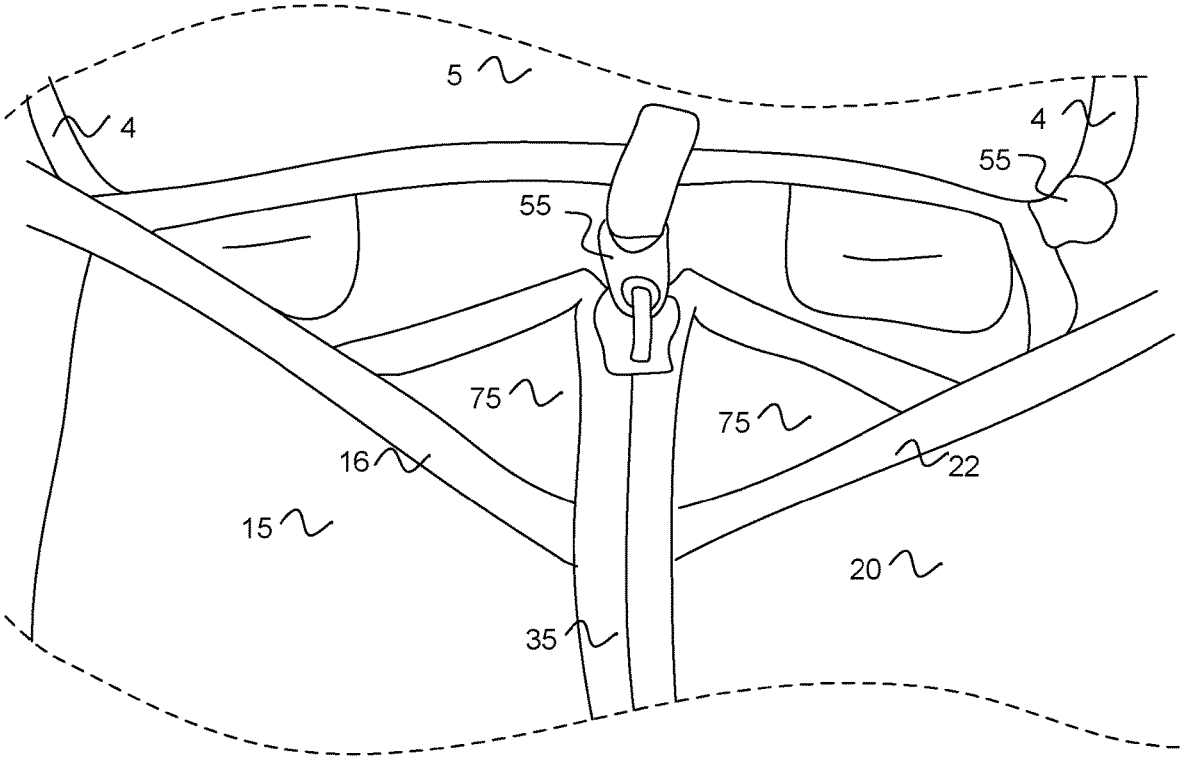
FIG. 6 is a sectional view of a tri-zipper area of the backpack collapsible suspension chair in accordance with an embodiment of the present disclosure.

FIG. 6 is a sectional view of a tri-zipper area of the backpack collapsible suspension chair in accordance with an embodiment of the present disclosure. The zippered perimeter 4 of the top piece 5 is zippered to the perimeters 16 and 22 of the two side pieces to cover the tri-zipper areas 75 and the zipper end 55. A similar arrangement is made with the bottom piece 30 and respective zippered edges of the bottom edges of side pieces 15 and 20. The tri-zipper areas 75 provide overlap and a splash guard gusset for closure of the hood top piece and the seat bottom piece 30.

Figure 7:
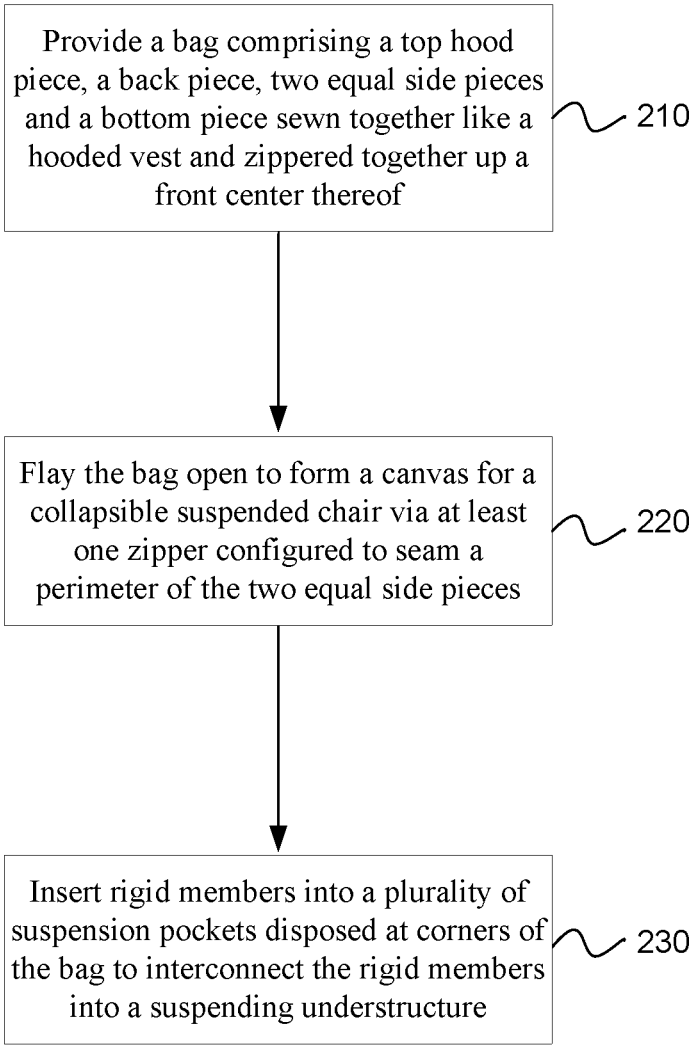
FIG. 7 is a flow diagram of a method for transforming a backpack into a furnishing for a body at rest in accordance with an embodiment of the present disclosure.

FIG. 7 is a flow diagram of a method for transforming a backpack into a furnishing for a body at rest in accordance with an embodiment of the present disclosure. A method of transforming a backpack into a furnishing for a body at rest includes providing 210 a bag comprising a top hood piece, a back piece, two equal side pieces and a bottom piece sewn together like a hooded vest and zippered together up a front center thereof to form the bag. The method also includes flaying 220 the bag open to form a canvas for a suspended chair via at least one zipper configured to seam a perimeter of the two equal side pieces to a perimeter of the head piece and to a perimeter of the bottom piece. The method further includes inserting 230 rigid members into a plurality of suspension pockets disposed at corners of the bag to interconnect the rigid members into a suspending understructure.

Therefore, the present disclosure satisfies the long felt need for an economical, secure and convenient backpack chair that is also able to easily transform into other camping equipment. The disclosed backpack chair may also be used as a bivy, a hammock, a matt and a vest. An inflating roll, attachable to an inside of the backpack chair rolls out to provide the matt and the bivy canopy as needed. The suspension members or collapsible poles may also be used to rig the bivy using the same suspension pockets, gussets and components provided for the backpack and the transformed chair thereof. The present disclosure therefore is poised to become the transformer product of choice for hunters, fisherman and the survivalist hereafter to be known as the Chameleon™ backpack series.

Although the operations of the method(s) herein are shown and described in a particular order, the order of the operations of each method may be altered so that certain operations may be performed in an inverse order or so that certain operations may be performed, at least in part, concurrently with other operations. In another embodiment, instructions or sub-operations of distinct operations may be implemented in an intermittent and/or alternating manner.

Notwithstanding specific embodiments of the invention have been described and illustrated, the invention is not to be limited to the specific forms or arrangements of parts so described and illustrated. The scope of the invention is to be defined by the claims and their equivalents included herein or by reference to a related application.

What is claimed is:

1. A backpack chair comprising:

a bag comprising a bottom piece, a back piece and two symmetric side pieces having a plurality of suspension pockets disposed at reinforced corners on a surface opposite a sitting surface, the suspension pockets configured to receive a respective end of members of a suspending under structure;

a backpack configuration having an outside which becomes the sitting surface of the backpack chair, the backpack comprising a top piece and an apron sewn into a cupping shape;

at least one zipper configured to seam a perimeter of the two symmetric side pieces to a perimeter of the top piece and to a perimeter of the bottom piece to form the bag;

and at least one strap detachably connected to the backpack, the at least one strap configured to allow the backpack to be carried on a user's back, a user's shoulder and in a user's hand or crook of a user's arm or around a user's waist.

2. The backpack chair of claim 1, further comprising a plurality of lightweight poles configured to interconnect at ends thereof into a suspending understructure at corners of the bag flayed open as a chair.

3. The backpack chair of claim 1, wherein the plurality of suspension pockets also are configured adjacent a reinforced corner to receive a supporting understructure to form a hammock.

4. The backpack chair of claim 1, wherein the backpack is flayed open and multiple pads on an outside of the back piece transform the backpack into a sleeping pad for a user.

5. The backpack chair of claim 1, wherein the backpack is flayed open and transforms via zipperable side seams to allow wearing by a user.

6. The backpack chair of claim 1, further comprising a plurality of chest straps adaptable to be turned backwards to strap the bag to the interconnected suspending understructure.

7. The backpack chair of claim 1, wherein the two symmetric side pieces comprise pockets configured both for backpack use and for chair 'accessories' use.

8. The backpack chair of claim 1, further comprising a padding on the back piece for back pack use transformable as padding for chair use.

9. The backpack chair of claim 1, wherein the two symmetric side pieces are entirely detachable from the bag by zippered seams.

10. The backpack chair of claim 1, further including a plurality of webbing straps sewn onto an outside of the two equal sides.

11. A backpack chair comprising:

a bag comprising a top hood piece, a back piece, two equal side pieces, an apron sewn into a cupping shape inside the bag and turned outside the bag for sitting, the bag seamed together and zippered together up a front center thereof with a perimeter of a bottom piece to form the bag;

a tri zipper track comprising a top zipper track configured to seam the top hood piece to the two equal side pieces, a bottom zipper track to seam the bottom piece to the two equal side pieces and a center zipper track to seam the two equal side pieces together;

a penta slider pull comprising a first slider pull on a first portion of the top zipper track, a second slider pull on another section of the top zipper track, a third slider pull on a first portion of the bottom zipper track, a fourth slider pull on another section of the bottom zipper track and a fifth slider pull on the center zipper track; and a plurality of inside-out suspension pockets disposed at corners of the bag turned outside the bag for sitting including two each disposed at two bottom corners thereof for rigid members to be inserted therein to interconnect into a suspending understructure.

12. The backpack chair of claim 11, further comprising two shoulder straps attached to the bag that allow it to be carried on one's back, the shoulder straps securely attached to a top of the back piece and detachably connected to a back of the bottom piece.

13. The backpack chair of claim 11, further comprising a plurality of lightweight aluminum poles configured to interconnect into the suspending understructure.

14. The backpack chair of claim 11, wherein the plurality of suspension pockets are configured adjacent a reinforced corner at the corners to receive a supporting understructure to form a hammock.

15. The backpack chair of claim 11, wherein the backpack is flayed open and multiple pads on the back piece transform the backpack into a sleeping pad for a user.

16. The backpack chair of claim 11, wherein the bag is flayed open and transforms via zipperable side seams thereof.

17. The backpack chair of claim 11, further comprising a plurality of chest straps adaptable to be turned backwards to strap the bag to the interconnected suspending understructure.

18. The backpack chair of claim 11, further comprising a padding on the back piece for back pack use transformable as padding for chair use.

19. A method of transforming a backpack into a furnishing for a body at rest, the method comprising:

sewing a bag comprising a top hood piece, a back piece, two equal side pieces, an apron sewn into a cupping shape inside the bag and turned outside the bag for sitting, together and zippered together up a front center thereof to form the bag;

flaying the bag open to form a canvas for a suspended chair via at least one zipper configured to seam a perimeter of the two equal side pieces to a perimeter of the head piece and to a perimeter of a bottom piece; and inserting rigid members into a plurality of inside-out suspension pockets inside the bag disposed at corners of the bag turned outside the bag for sitting to interconnect the rigid members into a suspending understructure.

* * * * *